US009102032B2

(12) United States Patent
Nakamura et al.

(10) Patent No.: US 9,102,032 B2
(45) Date of Patent: Aug. 11, 2015

(54) DISC GRINDERS

(75) Inventors: Shin Nakamura, Anjo (JP); Kenji Mukoyama, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 760 days.

(21) Appl. No.: 13/285,463

(22) Filed: Oct. 31, 2011

(65) Prior Publication Data

US 2012/0108154 A1 May 3, 2012

(30) Foreign Application Priority Data

Nov. 2, 2010 (JP) ..... 2010-246028

(51) Int. Cl.
*B24B 55/05* (2006.01)
*B24B 23/02* (2006.01)

(52) U.S. Cl.
CPC ..... *B24B 23/028* (2013.01); *B24B 55/05* (2013.01)

(58) Field of Classification Search
CPC ..... B24B 23/028; B24B 55/05
USPC ..... 451/359, 451, 452, 454
See application file for complete search history.

(56) References Cited

U.S. PATENT DOCUMENTS

| | | | | |
|---|---|---|---|---|
| 4,059,930 | A * | 11/1977 | Alessio | 451/451 |
| 4,924,635 | A * | 5/1990 | Rudolf et al. | 451/344 |
| 5,005,321 | A * | 4/1991 | Barth et al. | 451/359 |
| 5,163,252 | A * | 11/1992 | Garner et al. | 451/451 |
| 6,464,573 | B1 * | 10/2002 | Keller | 451/451 |
| 6,893,334 | B1 * | 5/2005 | Stivers | 451/359 |
| 6,949,017 | B2 * | 9/2005 | Koschel et al. | 451/358 |
| 7,014,547 | B2 * | 3/2006 | Kleider | 451/359 |
| 7,311,589 | B2 * | 12/2007 | Wiker | 451/451 |
| 8,011,997 | B2 * | 9/2011 | Voigt et al. | 451/452 |
| 8,403,730 | B2 * | 3/2013 | Numata et al. | 451/359 |
| 2004/0157541 | A1 * | 8/2004 | Wendt et al. | 451/451 |
| 2006/0286910 | A1 * | 12/2006 | Voigt et al. | 451/359 |
| 2010/0210195 | A1 * | 8/2010 | Numata et al. | 451/451 |
| 2010/0248599 | A1 * | 9/2010 | Voigt et al. | 451/359 |
| 2010/0304648 | A1 * | 12/2010 | Boeck et al. | 451/451 |
| 2012/0252328 | A1 * | 10/2012 | Muto et al. | 451/453 |

FOREIGN PATENT DOCUMENTS

| | | | | |
|---|---|---|---|---|
| DE | 103 48 395 | A1 | 5/2005 | |
| EP | 2 214 866 | | 6/2009 | |
| EP | 2 119 534 | A1 | 11/2009 | |
| EP | 2119534 | A1 * | 11/2009 | B24B 55/05 |
| EP | 2 204 262 | A1 | 7/2010 | |
| WO | WO 2009068341 | A1 * | 6/2009 | |

OTHER PUBLICATIONS

European Search Report issued in Application No. 11187463.2; Dated Nov. 20, 2013.

* cited by examiner

*Primary Examiner* — Joseph J Hail
*Assistant Examiner* — Marc Carlson
(74) *Attorney, Agent, or Firm* — Oliff PLC

(57) ABSTRACT

A disc grinder includes a grinding wheel cover rotatably mounted to a gear housing about an axis of a spindle. A stopper device can restrict a position adjustable range of the grinding wheel cover of the spindle and includes a first stopper on the side of the grinding wheel cover and a second stopper on the side of the gear housing. The first stopper and the second stopper have stopper surfaces for contacting with each other. An impact absorbing device can absorb an impact produced when the stopper surfaces contact with each other.

17 Claims, 5 Drawing Sheets

DISC GRINDERS

This application claims priority to Japanese patent application serial number 2010-246028, the contents of which are incorporated herein by reference.

BACKGROUND OF THE INVENTION

1. Field of the Invention

The present invention relates to disc grinders, such as hand-held disc grinders, used for grinding stone or the any other materials.

2. Description of the Related Art

In general, hand-held electric disc grinders have a substantially cylindrical body section and an electric motor disposed within the body section. In order to perform a grinding operation, the user may grasp the body section, so that the body section serves as a grip member. One the front side of the body section, there is disposed a reduction gear section including a bevel gear train that reduces the rotation of the electric motor and transmits the rotational output in a direction perpendicular to the motor axis. Therefore, a spindle disposed on an output side of the reduction gear mechanism extends perpendicular to the motor axis. A circular grinding wheel is mounted to a front end of the spindle. Substantially rear half of the circumference (on the side of the user) of the grinding wheel is covered by a grinding wheel cover for preventing ground powder or the like produced during the grinding operation (hereinafter simply called powder dust) from scattering toward the side of the user.

For the convenience of the operation for exchanging the grinding wheel or any other operation, the grinding wheel cover is configured to be detachable. In addition, the position of the grinding wheel cover about the rotational axis of the spindle can be changed, so that the position of covering the grinding wheel can be changed in accordance with the posture of the user during the operation. Typically, the grinding wheel cover has an annular mounting band portion that can be mounted to a cylindrical boss portion of the reduction gear section and can be fastened thereto by tightening a fixing screw. Therefore, loosening the fixing screw can release the mounting band portion for removing the grinding wheel cover or for changing the position of the grinding wheel cover, In the case of the grinding wheel cover having the mounting structure as described above, the powder dust may scatter to the side of the user if the user adjusts the grinding wheel cover unintentionally to a position where the grinding wheel cover is opened by a large angle toward the user. Therefore, in some cases, the structure enabling adjustment to a desired position has invited an undesired situation from a viewpoint of preventing the powder dust from scattering.

In addition, if the fixing screw has not been sufficiently tightened, it may be possible that the position of the grinding wheel cover is shifted toward an open position, for example, in the case that the grinding wheel cover contacts an object to be ground. In such a case, the function of preventing the powder dust from scattering may not be sufficiently performed.

In order to solve the above problem, US2010/0210195A (corresponding to International Publication No. WO2009/054275) has proposed to provide a stopper projection on a mounting band portion of a grinding wheel cover and to provided a stopper contact portion on the side of a reduction gear section, so that the grinding wheel cover is prevented from rotating further after the stopper projection has contacted the stopper contact portion. Therefore, the position adjustable range of the grinding wheel cover is limited within a predetermined angular range. With this technique, it is possible to avoid such an occasion that the user unintentionally adjusts the position of the grinding wheel cover by a large angle more than necessary. In addition, it is possible to maintain the grinding wheel cover within an adequate angular range even in the case that the grinding wheel cover has contacted an object to be ground. Therefore, the function of preventing the powder dust from scattering toward the user can be reliably preformed.

However, the grinding wheel cover of the above publication has still required an improvement. In the case of the technique of the above publication, the position adjustable range of the grinding wheel cover is limited within a predetermined angular range through contact of the stopper projection on the side of the grinding wheel cover with the stopper contact portion on the side of the reduction gear section. However, if the grinding wheel cover contacts an object to be ground with a strong impact force, the stopper projection may contact the stopper contact portion also with a strong impact force.

Therefore, there has been a need in the art to improve the durability of the grinding wheel cover against the impact force.

SUMMARY OF THE INVENTION

According to the present teaching, a disc grinder includes a grinding wheel cover rotatably mounted to a gear housing about an axis of a spindle. A stopper device can restrict a position adjustable range of the grinding wheel cover of the spindle and includes a first stopper on the side of the gear housing and a second stopper on the side of the grinding wheel cover. The first stopper and the second stopper have stopper surfaces for contacting with each other. An impact absorbing device can absorb an impact produced when the stopper surfaces contact with each other.

DETAILED DESCRIPTION OF THE INVENTION

Figure 1:
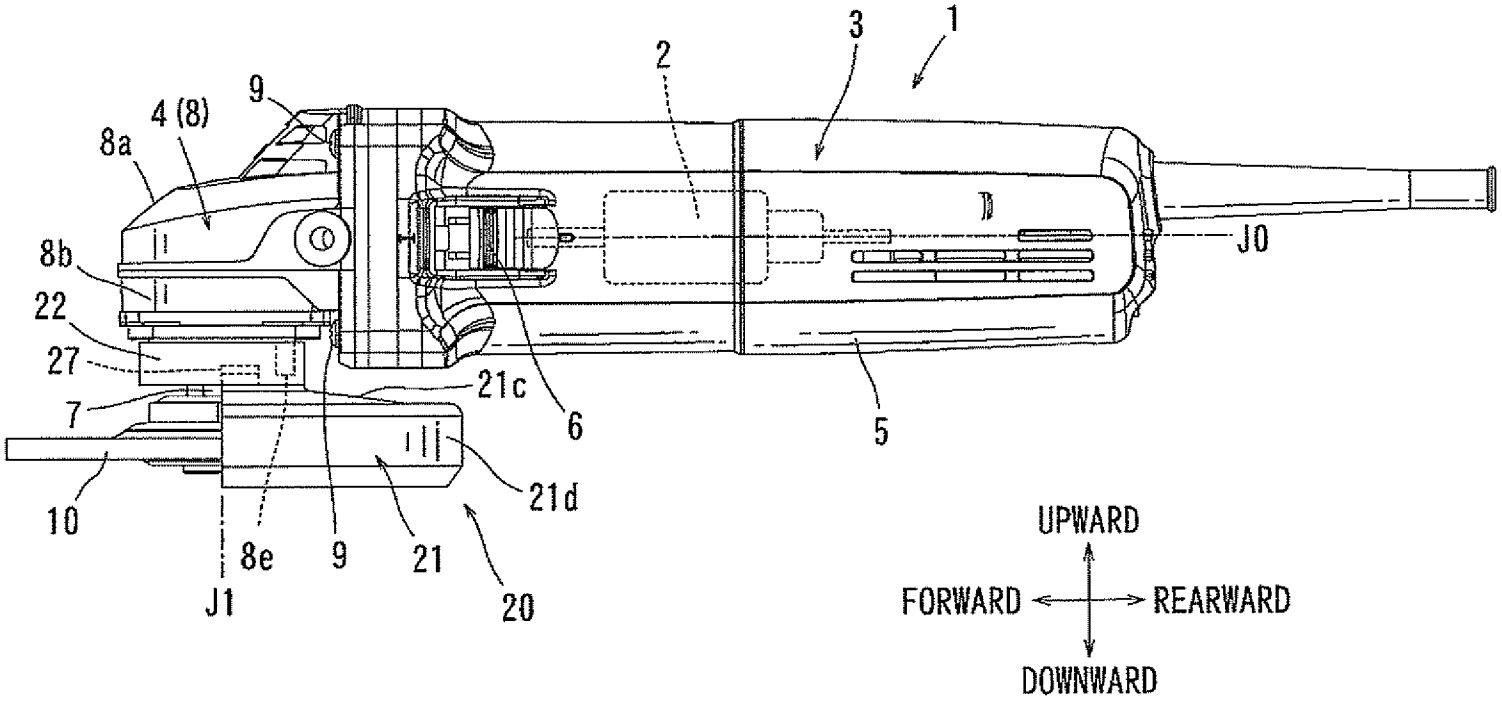
FIG. 1 is a lateral side view of a disc grinder according to a representative example of the present invention.

Each of the additional features and teachings disclosed above and below may be utilized separately or in conjunction with other features and teachings to provide improved disc grinders. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a disc grinder includes a body section and a reduction gear section. The body section has a drive source for producing a rotational output. The reduction gear section is configured to reduce rotational output of the drive source. A spindle is coupled to the reduction gear section and receives the reduced rotational output from the reduction gear section. The spindle has a rotational axis in a direction intersecting with a longitudinal axis or a body axis of the body section and is configured to be able to mount a circular grinding wheel thereto. A grinding wheel cover includes a cover body portion configured to be able to cover the circumference of the grinding wheel and a mounting band portion capable of being mounted to a gear housing of the reduction gear section. The mounting band portion is fastened around the gear housing as a fixing screw is tightened. A stopper projection is provided on the mounting band portion. A stopper contact portion is provided on the gear housing. Therefore, a position adjustable range of the grinding wheel cover about the rotational axis of the spindle is restricted through contact between a stopper surface of the stopper projection and a stopper surface of the stopper contact portion. At least one of the stopper surfaces of the stopper projection and the stopper contact portion is inclined relative to a radial direction with respect to the rotational axis of the spindle.

With this arrangement, because the grinding wheel cover is supported by the gear housing so as to be able to adjust the position about the rotational axis of the spindle, the position of the grinding wheel cover can be set to a suitable position depending on the mode of operation, etc., so that it is possible to preventing powder dust from scattering toward the user and to enable the operation to be efficiently performed. In addition, because the position adjustable range of the grinding wheel cover in the rotational direction of the grinding wheel can be limited within a predetermined range by the stopper projection and the stopper contact portion, it is possible to avoid such an occasion that the user adjusts the grinding wheel cover unintentionally to a position where the function of preventing powder dust from scattering cannot be sufficiently performed. Further, even in the event that the grinding wheel cover contacts an object to be ground or the like, it is possible to prevent the grinding wheel cover from shifting to a position where the function of preventing powder dust from scattering cannot be sufficiently performed.

Further, in the construction in which the position adjustable range of the grinding wheel cover is restricted through contact between the stopper surface of the stopper projection on the side of the grinding wheel cover and the stopper contact portion on the side of the reduction gear section, at least one of the stopper surfaces of the stopper projection and the stopper contact portion is inclined relative to a radial direction with respect to the rotational axis of the spindle. Therefore, the contact area between the stopper surfaces increases as the stopper surfaces move toward each other. Hence, the impact produced by the contact between the stopper surfaces can be absorbed, and it is possible to reduce potential damage to the stopper projection and the stopper contact portion, so that the durability of the stopper projection and the stopper contact portion, and eventually the durability of the grinding wheel cover and the reduction gear section can be improved.

In addition, because the impact produced by the contact between the stopper surfaces is dispersed into a force component in a direction of inclination along the stopper surface(s) and a force component perpendicular to the inclination direction, potential damage to the stopper projection and the stopper contact portion can be reduced also in this respect. Therefore, the durability of the stopper projection and the stopper contact portion can be further improved.

In another example, a removal preventing projection is provided on an inner circumferential surface of the mounting band portion, and a removal preventing groove is formed in an outer circumferential surface of the gear housing. The removal preventing projection is inserted into the removal preventing groove, so that the mounting band portion is prevented from moving in the axial direction of the spindle relative to the gear housing.

With this arrangement, the movement of the stopper projection in the axial direction of the spindle can be reliably prevented. Therefore, it is possible to prevent the stopper projection from shifting in the axial direction of the spindle relative to the stopper contact portion even in the case that an impact force is produced due to contact between the stopper surfaces. As a result, the position adjustable range of the grinding wheel cover can be reliably restricted.

A representative example will now be described with reference to FIGS. 1 to 7. Referring to FIG. 1, there is shown a disc grinder 1 according to a representative example. For the purpose of explanation, the left side and the right side as viewed in FIG. 1 will be called a front side and a rear side, respectively, of the disc grinder 1.

The disc grinder 1 generally includes a body section 3 and a reduction gear section 4. The body section 3 has a substantially cylindrical body housing 5. An electric motor 2 serving as a drive source is disposed within the body housing 5. The body section 3, in particular its body housing 5, serves as a grip member and has a diameter set to allow the user to easily grasp the body housing 5. In order to operate the disc grinder 1, the user may be positioned on the rear side of the body section 3 and may grasp the body section 3 with his or her right hand. A slide-type main switch 6 is mounted to the body section 3 at a position on the left side as viewed from the side of the user. The user can move to slide the main switch 6 by using the thumb of his or her hand that grasps the body section 3, whereby the electric motor 2 is started.

The reduction gear section 4 is positioned on the front side of the body section 3. The reduction gear section 4 serves to reduce the rotational speed of the electric motor 2 and to transmit the reduced rotation to a spindle 7. The reduction gear section 4 includes a gear housing 8 and a bevel gear train (not shown) serving as a reduction gear mechanism and disposed within the gear housing 8. Therefore, as viewed from the lateral side, a rotational axis J1 of the spindle 7 extends perpendicular to the rotational axis of the electric motor 2. In this example, the rotational axis of the electric motor is the same as a body axis J0 of the body section 3. The body axis J0 is a longitudinal axis of the body section 3 or the body housing 5. In this example, the term "a view from the lateral side" or "a lateral side view" is used to mean a view as viewed from an anterior of the lateral side of the disc grinder 1 (a view shown in FIG. 1). In addition, in this example, the terms "leftward" and "rightward" are used to mean leftward and rightward with respect to the position of the user who is positioned for operating the disc grinder 1.

Figure 2:
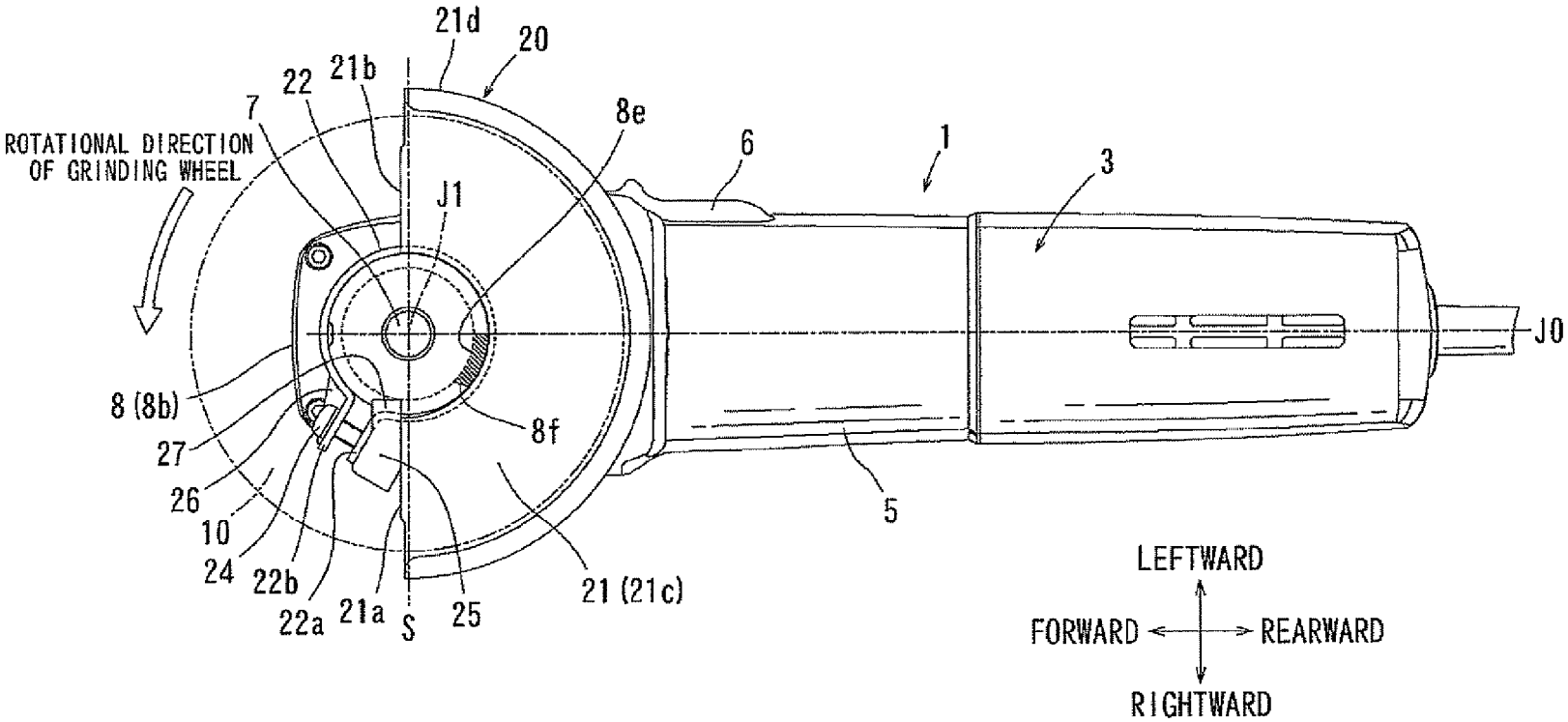
FIG. 2 is a bottom view of the disc grinder and showing a grinding wheel cover positioned at a reference position (in FIG. 2, a grinding wheel rotates in a counterclockwise direction)
Figure 3:
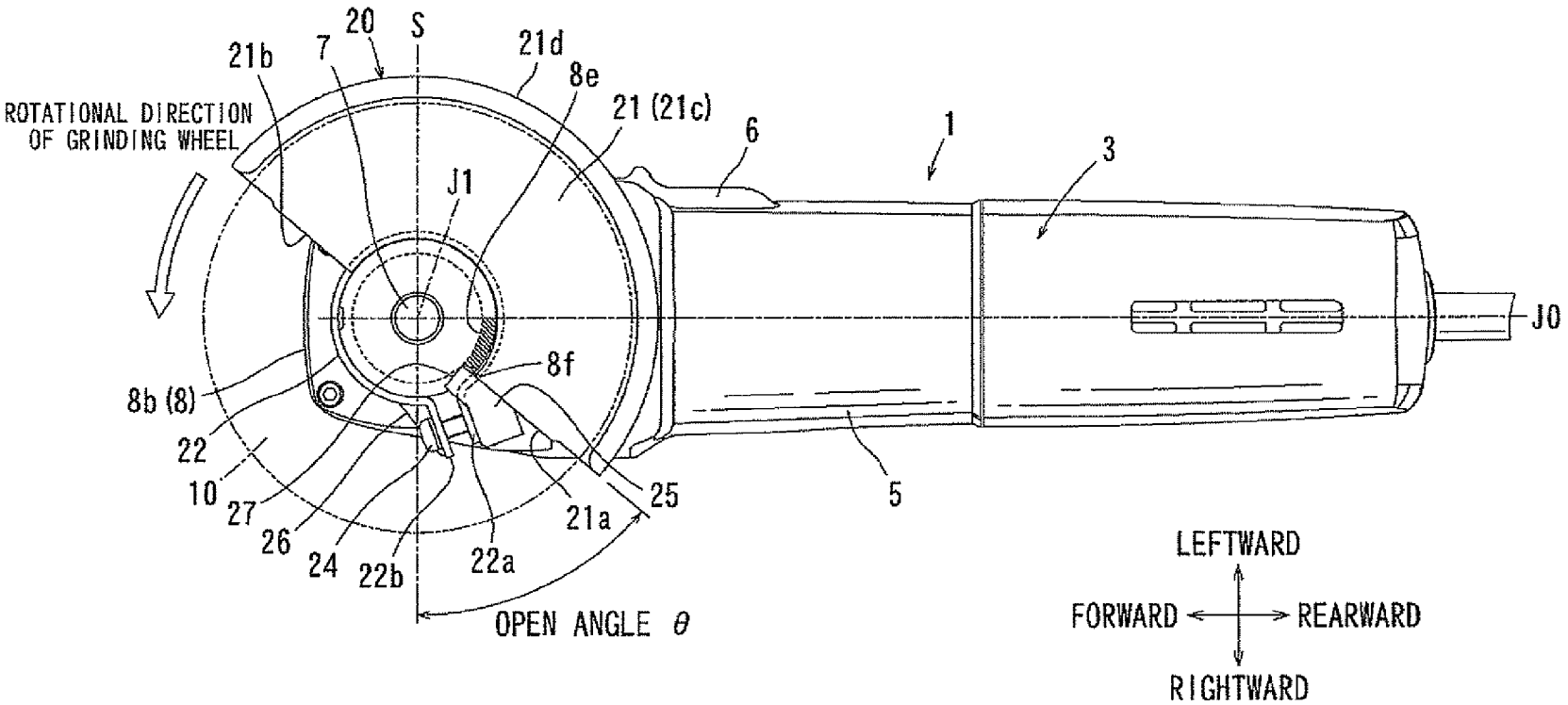
FIG. 3 is a bottom view of the disc grinder similar to FIG. 2 but showing the state where the grinding wheel cover has rotated from a reference position to a restricted position by an angle of about 60° and a stopper projection is in contact with a stopper contact portion (in FIG. 3, the grinding wheel rotates in a counterclockwise direction)
Figure 4:
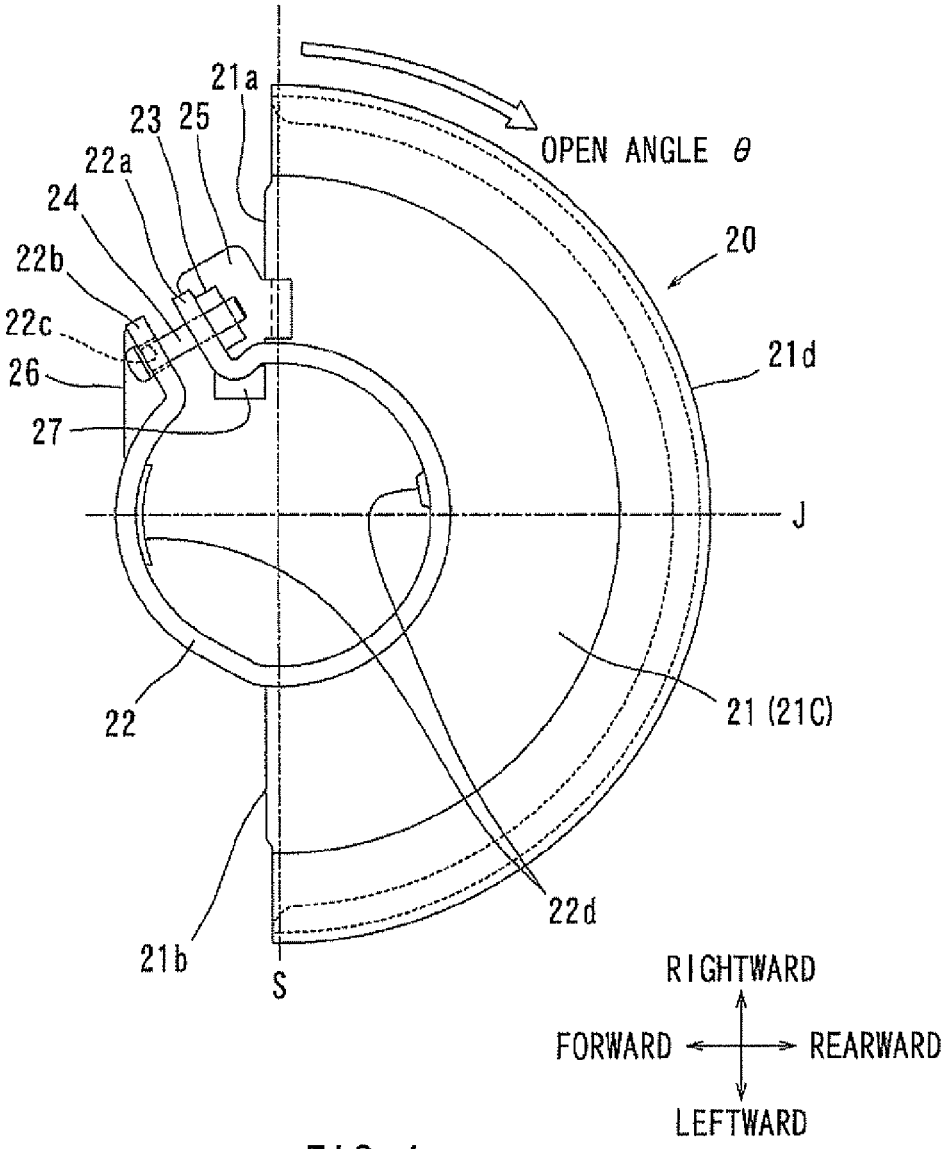
FIG. 4 is a plan view of the grinding wheel cover (in FIG. 4, the grinding wheel rotates in a clockwise direction as indicated by an outline arrow)

The gear housing 8 has an upper housing 8*a* and a lower housing 8*b*. The upper housing 8*a* is joined to the front end of the body housing 5 by means of mounting screws 9. The lower housing 8*b* is joined to the bottom of the upper housing 8*a* by means of screws (not shown). The spindle 7 protrudes downwardly from the lower housing 8*b* of the gear housing 8. A circular grinding wheel 10 is mounted to the protruded end portion of the spindle 7. The grinding wheel 10 rotates clockwise as viewed in a plan view. A grinding wheel cover 20 covers substantially rear half of the circumference (on the side of the user, the right side portion as viewed in FIG. 1) of the grinding wheel 10 for preventing powder dust from scattering toward the user. The details of the grinding wheel cover 20 are shown in FIGS. 2 to 4.

The grinding wheel cover 20 includes a cover body portion 21 and a mounting band portion 22. The cover body portion 21 covers substantially rear half of the circumference of the grinding wheel 10. The mounting band portion 22 is positioned on the upper side of the cover body portion 21 and can be closely fastened around the gear housing 8 so as to be fixed in position relative to the gear housing 8. The cover body portion 21 has a semicircular part 21*c* and a semicircularly curved part 21*d*. The semicircular part 21*c* is configured to cover the grinding wheel 10 from above. The semicircularly curved part 21*d* extends along the inner circumference of the semicircular part 21*c* and is fixedly attached thereto for covering the radially outer side of the grinding wheel 10. The semicircular part 21*c* has opposite edges 21*a* and 21*b* in the circumferential direction and the opposite edges 21*a* and 21*b* are positioned substantially in line with each other. The cover body portion 21 can cover mainly rear half of the circumference of the grinding wheel 10 for preventing powder dust from scattering toward the user (toward the rear side).

By fixing the mounting band portion 22 in position relative to the gear housing 8, the grinding wheel cover 20 is fixed in position for covering the rear half of the grinding wheel 10. The mounting band portion 22 is formed by bending a steel band plate along a circular arc. A cylindrical tubular portion 8*c* (see FIGS. 5 and 6) of the lower housing 8*b* of the gear housing 8 can be inserted into the mounting band portion 22. Opposite ends of the mounting band portion 22 are bent radially outward by an angle of about 90° to form fixing screw tightening portions 22*a* and 22*b* that are opposed to each other. A nut 23 is welded to one (22*a*) of the fixing screw tightening portions 22*a* and 22*b*. An insertion hole 22*c* for receiving a shank of a fixing screw 24 is formed in the other (22*b*) of the fixing screw tightening portions 22*a* and 22*b*.

Reinforcing plates 25 and 26 are welded to the fixing screw tightening portions 22*a* and 22*b*, respectively. More specifically, the reinforcing plate 25 is welded to the lower portion of the fixing screw tightening portion 22*a* and also to the upper surface of the cover body portion 21 so as to extend therebetween. The reinforcing plate 26 is welded to the lower portion of the fixing screw tightening portion 22*b* and also to the mounting band portion 22 so as to extend therebetween. With these reinforcing plates 25 and 26, the outwardly bent configurations (i.e., the opposed relationship) of the fixing screw tightening portions 22*a* and 22*b* are firmly maintained. Therefore, it is possible to reliably maintain the tightening state of the fixing screw 24, hence, the mounting state of the mounting band potion 22 to the gear housing 8 (the fastening state of the mounting band portion 22 around the gear housing 8) can be maintained, so that the mounting band portion 22 is prevented from being accidentally loosened.

A stopper projection 27 (hereinafter also called "first stopper 27") is formed integrally with the reinforcing plate 25 on the side of the fixing screw tightening portion 22*a* and protrudes inwardly of the mounting band portion 22. The function of the stopper projection 27 will be explained later.

Figure 5:
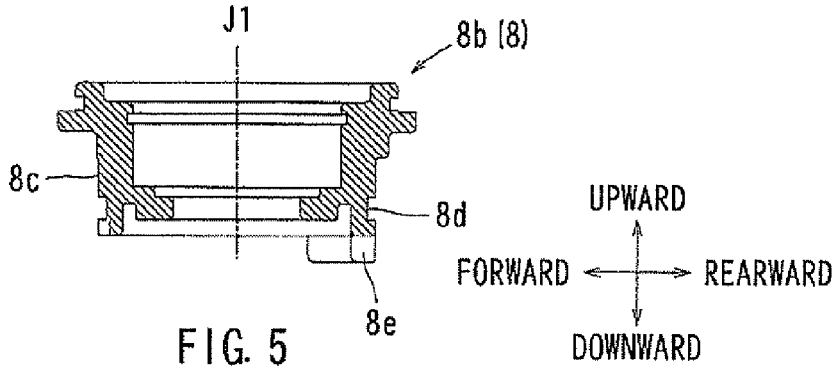
FIG. 5 is a vertical sectional view of a lower housing of a gear housing of the disc grinder.
Figure 6:
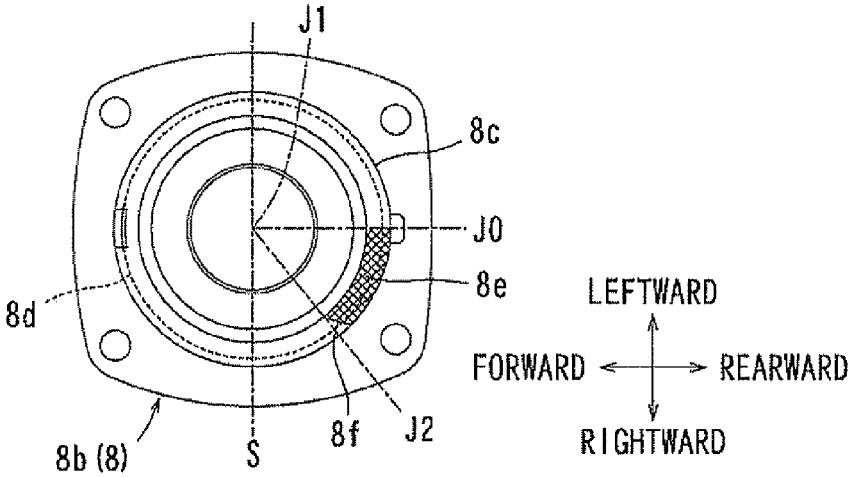
FIG. 6 is a bottom view of the lower housing of the gear housing.

Removable preventing projections 22*d* are formed on the inner circumferential surface of the mounting band portion 22 and serve to prevent the mounting band portion 22 from being removed from the lower housing 8*b* of the gear housing 8. The details of the lower housing 8*b* of the gear housing 8 are shown in FIGS. 5 and 6. A removal preventing groove 8*d* configured to receive the removal preventing projections 22*d* is formed in the outer circumferential surface of the cylindrical tubular portion 8*c* of the lower housing 8*b* and extends throughout its entire circumference. The cylindrical tubular portion 8*c* is inserted into the mounting band portion 22 in the state that the removal preventing projections 22*d* are inserted into the removal preventing groove 8*d*. As the fixing screw 24 is tightened in this state, the mounting band portion 22 is fastened around the cylindrical tubular portion 8*c*, so that the grinding wheel cover 20 is fixed in position relative to the gear housing 8.

Although not shown in FIGS. 5 and 6, a bearing for rotatably supporting the spindle 7, a dust preventing seal ring, etc. are assembled within the lower housing 8*b* of the gear housing 8, and the spindle 7 is supported so as to protrude downward from the center of the lower housing 8*b*.

A stopper contact portion 8*e* (herein after also called "second stopper 8*e*) is formed integrally with the lower portion of the lower housing 8*b* and extends along the lower surface of the cylindrical tubular portion 8*c* within a range that is enough to perform a given function that will be explained later.

As shown in FIGS. 2 and 3, in the mounting state of the grinding wheel cover 20 to the gear housing 8, the stopper projection 27 of the mounting band portion 22 is positioned to be opposed to the stopper contact portion 8*e* in the circumferential direction. Therefore, although the grinding wheel cover 20 can be rotated relative to the gear housing 8 about the rotational axis J1 of the spindle 7 by loosening the fixing screw 24, the range of rotation of the grinding wheel cover 20 is limited within a predetermined range. In other words, a region of the grinding wheel 10 covered by the grinding wheel cover 20 (i.e., a shielded region) may be shifted within a predetermined range. In this way, the stopper projection 27 and the stopper contact portion 8*e* serve as a stopper device for stopping rotation of the grinding wheel cover 20 or restricting the rotational range of the grinding wheel cover 20.

Figure 7:
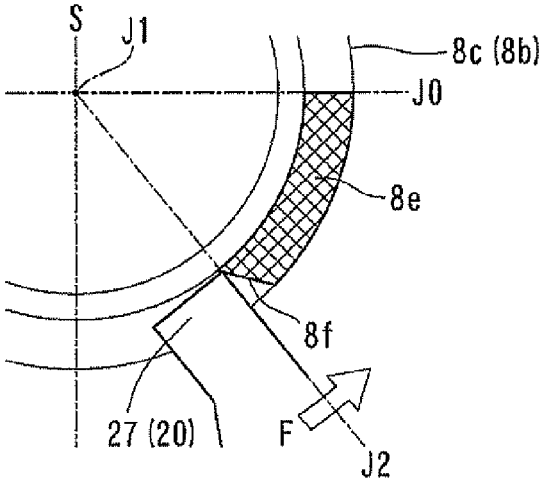
FIG. 7 is a partial bottom view showing the state where the stopper projection and the stopper contact portion contact with each other.

As shown in FIG. 7, the stopper contact portion 8*e* has opposite end surfaces in the circumferential direction of the gear housing 8. One (labeled with reference numeral 8*f* in FIG. 7) of the end surfaces is inclined by a small angle relative to a line J2 extending in a radial direction from the rotational axis J1 of the spindle 7. More specifically, the end surface 8*f* is inclined in the rotational direction of the grinding wheel 10 along the radially outward direction. The end surfaces of the stopper contact portion 8*e* will be hereinafter also called "stopper surfaces."

With the grinding stone cover 20 described above, the covering region (shield region) of the grinding wheel 10 can be adjusted by loosening the fixing screw 24 and rotating the grinding wheel cover 20 about the rotational axis J1 of the spindle 7, while the adjustable range being limited within a predetermined range through contact of the stopper projection (first stopper) 27 with the stopper contact portion (second stopper) 8*e* as shown in FIG. 3. In this example, the adjustable range of the grinding wheel cover 20 is determined such that an open angle θ from a reference position S in FIG. 3 is limited within an angle of between 0° and 60°. In the reference position S (0° open position) shown in FIG. 3, the edge 21*a* of the grinding wheel cover 20 positioned on the front side with respect to the rotational direction (counterclockwise direction in FIGS. 2 and 3) of the grinding wheel 10 extends perpendicular to the body axis J0 of the body section 3 as viewed in a plan view. When the grinding wheel cover 20 is rotated from the reference position S by an angle of 60° in the rotational direction of the grinding wheel 10 indicated by an outline arrow in FIG. 4, the grinding wheel cover 20 reaches a 60° open position shown in FIG. 3. The grinding wheel cover 20 is prevented from rotating further from the 60° open position in the rotational direction of the grinding wheel 10.

Thus, when the grinding wheel cover 20 is rotated from the reference position S by an angle of 60° in the rotational direction of the grinding wheel 10 (counterclockwise direction in FIG. 3, clockwise direction in FIG. 4), the stopper projection or the first stopper 27 contacts the end surface (stopper surface) 8*f* of the stopper contact portion or the second stopper 8*e* to prevent further rotation of the grinding wheel cover 20. As a result, the position adjustable range of the grinding wheel cover 20 in the rotational direction of the grinding wheel 10 is restricted.

The stopper projection 27 and the stopper contact portion 8*e* do not prevent the rotation of the grinding wheel cover 20 from the reference position S in the direction opposite to the rotational direction of the grinding wheel 10. Therefore, it is still possible to ensure a large adjustable range of the grinding wheel cover 20. Thus, in the case that the position of the grinding wheel cover 20 is adjusted by rotating the grinding wheel cover 20 from the reference position S in the direction opposite to the rotational direction of the grinding wheel 10, the powder dust scattering from the grinding wheel 10 may not cause a substantial problem for the user because the grinding wheel cover 20 is opened in the direction opposite to the rotational direction of the grinding wheel 10 (or is opened in the clockwise direction in FIG. 2). In this way, according to this example, restriction of rotation by the stopper projection 27 and the stopper contact portion 8*e* may not occur when the grinding wheel cover 20 is rotated in the direction opposite to the rotational direction of the grinding wheel 10. As a result, the grinding operation or other operations relating to the disc grinder 1 can be made by opening the grinding wheel cover 20 by a large angle from the reference position S, so that the operability of the disc grinder 1 can be ensured.

If the powder dust or the like scatters due to rotation of the grinding wheel 10 and collides with the inner circumferential surface of the semicircularly curved portion 21*d* of the grinding wheel cover 20 during the grinding operation, a force may be produced due to collision of the powder dust or the like and may be momentarily applied to the grinding wheel cover 20. One way to address this situation is to further tighten the fixing screw 24 in order to further firmly fix the grinding wheel cover 20 in position. However, if the mounting band portion 22 of the grinding wheel cover 20 is fastened more than necessary around the cylindrical tubular portion 8*c* of the gear housing 8, it may be possible to cause an adverse affect to the bearing (not shown) that supports the spindle 7. In addition, if it is necessary to rotate the grinding wheel cover 20 by an angle suitable for a work to be performed, the user needs to perform troublesome operations of loosening the firmly tightened screw 24 and tightening the fixing screw 24 again firmly.

According to the representative example, it is not necessary to firmly tighten the fixing screw 24 even in the case that a force produced due to collision of the powder dust or the like is momentarily applied to the grinding wheel cover 20. Thus, even in the event that the force applied to the grinding wheel cover 20 has caused rotation of the grinding wheel cover 20 in the rotational direction of the grinding wheel 10, the stopper projection 27 contacts the stopper contact portion 8*e* to prevent further rotation of the grinding wheel cover 20 when the grinding wheel cover 20 has rotated by an angle of 60° from the reference position S. Therefore, it is possible to reliably prevent the powder dust from scattering toward the user.

In addition, the stopper projection 27 contacts the stopper contact portion 8*e* at the stopper surface 8*f* that is inclined relative to the radial line J2. Therefore, the stopper projection 27 first contacts the stopper surface 81 in line-to-line contact relationship therewith, and thereafter contacts the stopper surface 8*f* in surface-to-surface contact relationship therewith due to deformation of the end portion of the stopper contact portion 8*e* having he stopper surface 8*f*, so that the contact area between the stopper projection 27 and the stopper surface 81 increases as the stopper projection 27 moves toward the stopper surface 81 after contacting it. Because the stopper projection 27 contacts the stopper surface 8*f* while the contact area between the stopper projection 27 and the stopper surface 8*f* gradually increases as the stopper projection 27 moves toward the stopper surface 8*f*, it is possible to absorb an impact force F (see FIG. 7) that may be applied to the semicircularly curved portion 21*d* of the cover body portion 21 due to collision of the powder dust, while preventing rotation of the grinding wheel cover 20. Therefore, it is possible to reduce potential damage to the stopper projection 27 and the stopper contact portion 8*e*, and hence, it is possible to improve the durability of the stopper projection 27 and the stopper contact portion 8*e*. In order to enable the deformation of the stopper contact portion 8*e*, the stopper contact portion 8*e* is made of material that is softer than the material of the stopper projection 27. For example, the stopper contact portion 8*e* may be made of aluminum. Thus, the lower member 8*b* of the gear housing 8 including the stopper contact portion 8*e* integrated therewith may be made of aluminum. On the other hand, the stopper projection 27 may be made of iron. Thus, the reinforcing plate 25 including the stopper projection 27 integrated therewith may be made of iron.

Further, because the stopper projection 27 contacts the stopper surface 8*f* that is inclined relative to the radial line 32 with respect to the rotational axis of the grinding wheel cover 20 (or the rotational axis J1 of the spindle 7), the impact force F is dispersed into a force component in a direction along the stopper surface 8*f* and a force component in a direction perpendicular to the direction along the stopper surface 8*f*. Therefore, it is possible to absorb or reduce the impact force F in comparison with the case where the stopper surface 8*f* extends along the radial line J2 and the entire area of the stopper surface 8*f* contacts the stopper projection 27 to directly receive the impact force F from the stopper projection 27. As a result, it is possible to improve the durability of the stopper projection 27 and the stopper contact portion 8*e* also in this respect.

In this way, the stopper projection 27 serves as an impact absorbing device due to its deformable characteristic, and the stopper surface 8*f* of the stopper contact portion 8*e* also serves as an impact absorbing device due to its inclination that enables gradual increase of the contact area and dispersion of the impact force F.

Furthermore, the function of restricting the position adjustable range of the grinding wheel cover 20 achieved by the stopper projection 27 and the stopper contact portion 8*e* is effective only with respect to the position adjustable range in the rotational direction of the grinding wheel 10 and is not effective with respect to the position adjustable range in the direction opposite to the rotational direction. Therefore, the adjustment of the position of the grinding wheel cover 20 in the direction opposite to the rotational direction can be made by a large angle. For this reason, even in the case that a whetstone is not used as the grinding wheel 10 but a diamond wheel is used for forming a groove in a concrete material, etc., the groove forming operation can be performed without being suffered from substantial inconvenience in terms of position adjusting function.

The above example can be modified in various ways. For example, although the stopper projection 27 is formed to extend inwardly from the inner circumference of the mounting band portion 22, the stopper projection 27 may be formed on the outer circumference of the mounting band portion 22 or may be formed on the cover body portion 21 or any other portion of the grinding wheel cover 20. Similarly, the stopper contact portion 8*e* may be formed at any position of the gear housing 8 depending on the position of the stopper projection 27 as long as the stopper projection 27 and the stopper contact portion 8*e* can contact with each other for preventing rotation of the grinding wheel cover 20 when the grinding wheel cover 20 has rotated from the reference position S by a predetermined angle, such as an angle of 60°.

In addition, although the stopper surface 8*f* of the stopper contact portion 8*e* is inclined relative to the radial line J2 in the above example, a surface inclined relative to the radial line J2 may be formed on the stopper projection 27 in place of or in addition to the stopper surface 8*f* of the stopper contact portion 8*e*.

Further, a rubber or any other resilient member serving as an impact absorbing device may be attached to the stopper contact portion 8*e* and/or the stopper projection 27. In such a case, the stopper surface 8*f* is not necessary to be inclined.

Furthermore, although the maximum open angle θ from the reference position S in the rotational direction of the grinding wheel 10 is set to be 60° in the above example, the maximum open angle θ may be determined to the other angle than 60° depending on the scattering range of the powder dust that is expected. For example, the maximum open angle θ may be set to be about 50° or about 70°.

Further, it is possible to set the stopper projection and the stopper contact portion such that the adjustment of the position of the grinding wheel cover 20 is possible only in the direction opposite to the rotational direction of the grinding wheel 10 from the reference position S.

Furthermore, in the above example, the body housing 5 of the disc grinder 1 is configured to be able to serve as a grip portion, and therefore, the disc grinder 1 has a relatively small size. However, the above teachings can be also applied to a grinding wheel cover of a disc grinder having a relatively large size and having a separate grip portion on the rear side of a body housing.

What is claimed is:

1. A disc grinder comprising:

a body section having a drive source for producing a rotational output;

a reduction gear section configured to reduce the rotational output of the drive source;

a spindle coupled to the reduction gear section and configured to receive the reduced rotational output from the reduction gear section;

wherein the spindle has a rotational axis in a direction intersecting with a longitudinal axis of the body section as viewed from a lateral side and is configured to be able to mount a circular grinding wheel thereto;

a grinding wheel cover including a cover body portion configured to be able to cover the circumference of the grinding wheel and a mounting band portion capable of being mounted to a gear housing of the reduction gear section, wherein the mounting band portion is capable of being fastened around the gear housing as a fixing screw is tightened;

a stopper projection provided on the mounting band portion; and a stopper contact portion provided on the gear housing;

wherein a position adjustable range of the grinding wheel cover about the rotational axis of the spindle is restricted through contact between a stopper surface of the stopper projection and a stopper surface of the stopper contact portion;

wherein the stopper contact portion extends along the gear housing in a circumferential direction about the rotational axis, the stopper contact portion forming a continuous cylindrical inner surface with one of opposite end portions of the stopper contact portion opposing to the stopper projection having an inclined surface so that a cross sectional area of the stopper contact portion with in a plane perpendicular to the rotational axis decreases in the circumferential direction toward the stopper projection: and wherein the inclined surface is inclined relative to a radial direction with respect to the rotational axis of the spindle, so that the inclined surface is deformed such that the cross sectional area of the stopper contact portion at the inclined surface increases at the stopper projection in order to absorb an impact produced when the stopper surfaces contact with each other.

2. The disc grinder as in claim 1, wherein;

a removal preventing projection is provided on an inner circumference of the mounting band portion, a removal preventing groove is formed in an outer circumferential of the gear housing, and the removal preventing projection is inserted into the removal preventing groove, so that the mounting band portion is prevented from moving in the axial direction of the spindle relative to the gear housing.

3. The disc grinder as in claim 1, wherein the grinding wheel rotates in one of clockwise and counterclockwise directions about the rotational axis of the spindle, and the position adjustable range of the grinding wheel cover is restricted in the rotational direction of the grinding wheel.

4. The disc grinder as in claim 1, wherein when the stopper surfaces of the stopper projection and the stopper contact portion contact with each other, one of the stopper surfaces contacts with the other of the stopper surfaces in line-to-line contact relationship therewith, and thereafter contacts the other of the stopper surfaces in surface-to-surface contact relationship therewith due to deformation of the at least one of the stopper surfaces.

5. The disc grinder as in claim 4, wherein one of the stopper surfaces of the stopper projection and the stopper contact portion extends in the radial direction with respect to the rotational axis of the spindle, wherein the other of the stopper surfaces is inclined relative to the radial direction and is deformed when an impact is applied.

6. The disc grinder as in claim 5, wherein:

the stopper surface of the stopper projection extends in the radial direction;

the stopper surface of the stopper contact portion is inclined relative to the radial direction and includes a first end and a second end, the first end and the second end are respectively positioned on a radially inner side and a radially outer side, so that the stopper surface of the stopper contact portion is inclined in the rotational direction of the spindle from the first end toward the second end.

7. A disc grinder comprising:

a body section having a body housing and having a drive source producing a rotational output, the body housing having a body axis;

a reduction gear section having a gear housing and configured to reduce the rotational output a spindle rotatable about a rotational axis and configured to be able to mount a circular grinding wheel thereto;

wherein the spindle is coupled to the gear section, so that the rotational output of the rotary drive source is transmitted to the spindle after being reduced by the reduction gear section;

wherein the rotational axis of the spindle is not parallel to the body axis;

a grinding wheel cover rotatable mounted to the gear housing about the rotational axis of the spindle;

a stopper device configured to restrict a position adjustable range of the grinding wheel cover about the rotational axis of the spindle and comprising a first stopper on the side of the grinding wheel cover and a second stopper on the side of the gear housing, the first stopper having a stopper surface and the second stopper having a stopper surface for contacting the stopper surface of the first stopper; and an impact absorbing device configured to absorb an impact produced when the stopper surfaces contact with each other;

wherein the impact absorbing device extends along the gear housing in a circumferential direction about the rotational axis, the impact absorbing device forming a Continuous cylindrical inner surface with the impact absorbing device having an inclined surface so that a cross sectional area of the impact absorbing device within a plane perpendicular to the rotational axis decreases in the circumferential direction toward a position between where the stopper surfaces contact each other; and wherein the impact absorbing device includes the inclined surface formed on at least one of the stopper surfaces of the first and second stoppers, the inclined surface being inclined relative to a radial direction with respect to the rotational axis of the spindle so that at least one of the stopper surfaces is deformed such that the cross sectional area of the impact absorbing device at the inclined surface increases between where the stopper surfaces contact each other in order to absorb an impact produced when the stopper surfaces contact with each other.

8. The disc grinder as in claim 7, wherein the grinding wheel rotates in one of clockwise and counterclockwise directions about the rotational axis of the spindle, and the stopper device restricts the position adjustable range of the grinding wheel cover in the rotational direction of the grinding wheel.

9. The disc grinder as in claim 8, wherein:

the stopper device prevents the grinding wheel cover from rotating beyond a restricting position in the rotational direction of the grinding wheel, the restricting position is displaced by a given angle from a reference position in the rotational direction of the grinding wheel, and the stopper surfaces of the first and second stoppers contact with each other when the grinding wheel cover is positioned at the restricting position.

10. The disc grinder as in claim 9, wherein the grinding wheel cover has opposite edges in the circumferential direction, the opposite edges are positioned in line with each other, the opposite edges are substantially perpendicular to the body axis when the grinding wheel cover is positioned at the reference position.

11. The disc grinder as in claim 10, wherein the given angle is about 60°.

12. The disc grinder as in claim 7, wherein:

a grinding wheel cover includes a cover body portion configured to be able to cover the circumference of the grinding wheel and a mounting band portion capable of being mounted to the gear housing of the reduction gear section, the mounting band portion is fastened around the gear housing as a fixing screw is tightened;

the first stopper is a stopper projection provided on the mounting band portion; and the second stopper is a stopper contact portion provided on the gear housing.

13. The disc grinder as in claim 12, wherein;

a removal preventing projection is provided on an inner circumference of the mounting band portion, a removal preventing groove is formed in an outer circumference of the gear housing, and the removal preventing projection is inserted into the removal preventing groove, so that the mounting band portion is prevented from moving in the axial direction of the spindle relative to the gear housing.

14. The disc grinder as in claim 7, wherein the rotational axis of the spindle extends in a direction intersecting with the body axis as viewed from a lateral side.

15. The disc grinder as in claim 7, wherein when the stopper surfaces of the first stopper and the second stopper contact with each other, one of the stopper surfaces contacts with the other of the stopper surfaces in line-to-line contact relationship therewith, and thereafter contacts the other of the stopper surfaces in surface-to-surface contact relationship therewith due to deformation of the at least one of the stopper surfaces.

16. The disc grinder as in claim 15, wherein one of the stopper surfaces of the first stopper and the second stopper extends in the radial direction with respect to the rotational axis of the spindle, wherein the other of the stopper surfaces is inclined relative to the radial direction and is deformed when an impact is applied.

17. The disc grinder as in claim 16, wherein:

the stopper surface of the first stopper extends in the radial direction;

the stopper surface of the second stopper is inclined relative to the radial direction and includes a first end and a second end, and the first end and the second end are respectively positioned on a radially inner side and a radially outer side, so that the stopper surface of the second stopper is inclined in the rotational direction of the spindle the spindle from the first end toward the second end.

* * * * *